US006895693B2

(12) United States Patent
Baruck

(10) Patent No.: US 6,895,693 B2
(45) Date of Patent: May 24, 2005

(54) DANCE SHOE

(75) Inventor: Glenn M. Baruck, Northbrook, IL (US)

(73) Assignee: Leo's Dancewear Inc., Chicago, IL (US)

( * ) Notice: Subject to any disclaimer, the term of this patent is extended or adjusted under 35 U.S.C. 154(b) by 0 days.

(21) Appl. No.: 10/033,987

(22) Filed: Dec. 28, 2001

(65) Prior Publication Data

US 2003/0121176 A1 Jul. 3, 2003

(51) Int. Cl.[7] ..... A43B 5/12
(52) U.S. Cl. ..... 36/8.3
(58) Field of Search ..... 36/8.3, 96, 113

(56) References Cited

U.S. PATENT DOCUMENTS

| | | | | | |
|---|---|---|---|---|---|
| 4,497 | A | | 5/1846 | Vetter | |
| 122,969 | A | | 1/1872 | Sage | |
| 297,103 | A | | 4/1884 | Beals | |
| 461,492 | A | | 10/1891 | Browning | |
| 492,994 | A | | 3/1893 | Sawyer | |
| 515,547 | A | | 2/1894 | Lissauer | |
| 955,337 | A | | 4/1910 | Lawlor | |
| 1,242,233 | A | | 10/1917 | Pierce | |
| 1,525,848 | A | * | 2/1925 | Bonaventure | 36/8.3 |
| 1,693,174 | A | * | 11/1928 | Capezio | 36/8.3 |
| 1,717,659 | A | | 6/1929 | Bunnell | |
| 1,726,198 | A | | 8/1929 | Stahl | |
| 1,738,177 | A | | 12/1929 | Esmonde | |
| 1,984,989 | A | | 12/1934 | Reed | |
| 2,082,537 | A | | 6/1937 | Butler | |
| 2,109,712 | A | | 3/1938 | Schmalz | |
| 2,124,458 | A | | 7/1938 | Buckler | |
| D119,496 | S | | 3/1940 | Haan | |
| 2,252,315 | A | | 8/1941 | Doree | |
| 2,298,941 | A | | 10/1942 | Herrmann | |
| D153,256 | S | | 4/1949 | Braga | |
| 2,487,247 | A | | 11/1949 | Kenny | |
| 2,708,321 | A | | 5/1955 | Cathers et al. | |
| 2,747,303 | A | | 5/1956 | Abrahams | |
| 3,007,262 | A | | 11/1961 | Richards | |
| 3,024,543 | A | | 3/1962 | Klym | |
| 3,121,287 | A | | 2/1964 | Patterson | |
| 3,487,830 | A | | 1/1970 | Pruett | |
| D267,366 | S | | 12/1982 | Davis | |
| 4,453,996 | A | * | 6/1984 | Terlizzi et al. | 156/227 |
| 4,494,320 | A | | 1/1985 | Davis | |
| 4,519,148 | A | | 5/1985 | Sisco | |
| 4,554,749 | A | | 11/1985 | Ostrander | |
| D282,022 | S | | 1/1986 | Wright | |
| 4,583,304 | A | | 4/1986 | Spalding | |
| 4,625,436 | A | | 12/1986 | Stevens, Jr. | |
| RE33,018 | E | | 8/1989 | Ostrander | |
| 4,866,860 | A | | 9/1989 | Blissett et al. | |
| 4,944,099 | A | | 7/1990 | Davis | |
| 4,991,318 | A | | 2/1991 | Cornell | |
| 5,035,069 | A | * | 7/1991 | Minden | 36/113 |
| 5,101,579 | A | * | 4/1992 | Terlizzi et al. | 36/8.3 |
| D345,449 | S | | 3/1994 | Armstrong | |
| 5,448,839 | A | | 9/1995 | Blissett et al. | |
| 5,459,946 | A | | 10/1995 | Rayow | |
| 5,539,020 | A | | 7/1996 | Bracken et al. | |
| 5,542,196 | A | | 8/1996 | Kantro | |
| 5,682,685 | A | * | 11/1997 | Terlizzi | 36/8.3 |
| D388,592 | S | * | 1/1998 | Minden | D2/919 |
| 5,809,666 | A | | 9/1998 | Harwood | |
| 5,956,868 | A | | 9/1999 | Stevens et al. | |
| 5,996,251 | A | | 12/1999 | LaDuca | |
| D420,784 | S | | 2/2000 | Riecken | |
| 6,092,306 | A | | 7/2000 | Newton-Dunn | |
| D438,367 | S | | 3/2001 | Huard | |
| 2002/0078591 | A1 | * | 6/2002 | Morrone | 36/8.3 |
| 2003/0029055 | A1 | * | 2/2003 | Morrone | 36/8.3 |

OTHER PUBLICATIONS

Leo's Dancewear 1999 Catalog, cover page and pp. 2–6, 11 and 23–26.

* cited by examiner

*Primary Examiner*—Ted Kavanaugh
(74) *Attorney, Agent, or Firm*—Leydig, Voit & Mayer, Ltd.

(57) ABSTRACT

The pointe show has an upper, a toe box and a split sole. The split sole has a front sole and a rear sole. The front sole may be located below the ball of the dancer's foot and the rear sole may be located below the heel of the dancer's foot. The split sole provides more flexibility to the pointe shoe and eliminates or reduces the "break in" of the shoe. Furthermore, the split sole shoe is lighter and easier for the dancer to rise up on her toes.

54 Claims, 10 Drawing Sheets

DANCE SHOE

The invention relates to dance shoes and more particularly to pointe shoes.

BACKGROUND OF THE INVENTION

Ballet dancers wear shoes specifically designed for ballet. These shoes permit the dancer to stand on the tips of their toes, which is referred to as dancing en pointe. Thus, these shoes are referred to as pointe shoes.

Pointe shoes have a box or block at the toes. The box covers the toes and provides support to stand en pointe. The pointe shoe also typically has an upper, a sole and a shank. The sole is on the bottom and the outside of the shoe. The sole extends from the toe to the heel and is usually made of leather. The sole is attached to the upper. The upper is often made of satin and surrounds the upper portion of the foot. The shank is a stiff material on the inside of the shoe which extends along the bottom of the foot above the sole.

One of the problems with pointe shoes is that they are too rigid in the center of the shoe between the toe and the heel. Often, the dancer needs to break in a shoe to obtain flexibility. A dancer may put the shoe in a vise or between a door and door jamb, and bend the shoe until the shoe becomes flexible.

There is a need for a pointe shoe which provides the proper support and is also more flexible.

SUMMARY OF THE INVENTION

The pointe shoe has an upper, a sole, a shank and a toe box. The upper surrounds the upper portion of the foot. The sole is a split sole and has a front sole and a rear sole. The front sole may be located below the ball of the dancer's foot and the rear sole may be located below the heel of the dancer's foot.

The shank is a stiff material on the inside of the shoe which extends along the bottom of the dancer's foot. The shank provides support for dancing en pointe. The shank may be available in different lengths, such as, full shank, three-fourths shank and one-half shank.

The toe box is a rigid structure which covers the toes of the dancer and provides support for the dancer to stand en pointe. The toe box is located at the front of the shoe and inside the upper. The toe box may have a flat tip which allows the dancer to stand en pointe.

The split outer sole, i.e. the front and rear soles, provide several potential benefits. The split outer sole provides more flexibility than a full sole shoe due to the lack of sole in the middle of the shoe. Furthermore, because the split sole shoe is more flexible, the split sole shoe does not require or reduces the amount of breaking in. In addition, due to the increased flexibility, the split sole shoe makes it easier for the dancer to rise up on her toes in comparison to a full sole shoe. Also, a split sole shoe is lighter in weight than a full sole shoe and the split sole shoe has a better appearance than a full sole shoe.

DETAILED DESCRIPTION OF THE INVENTION

Figure 1:
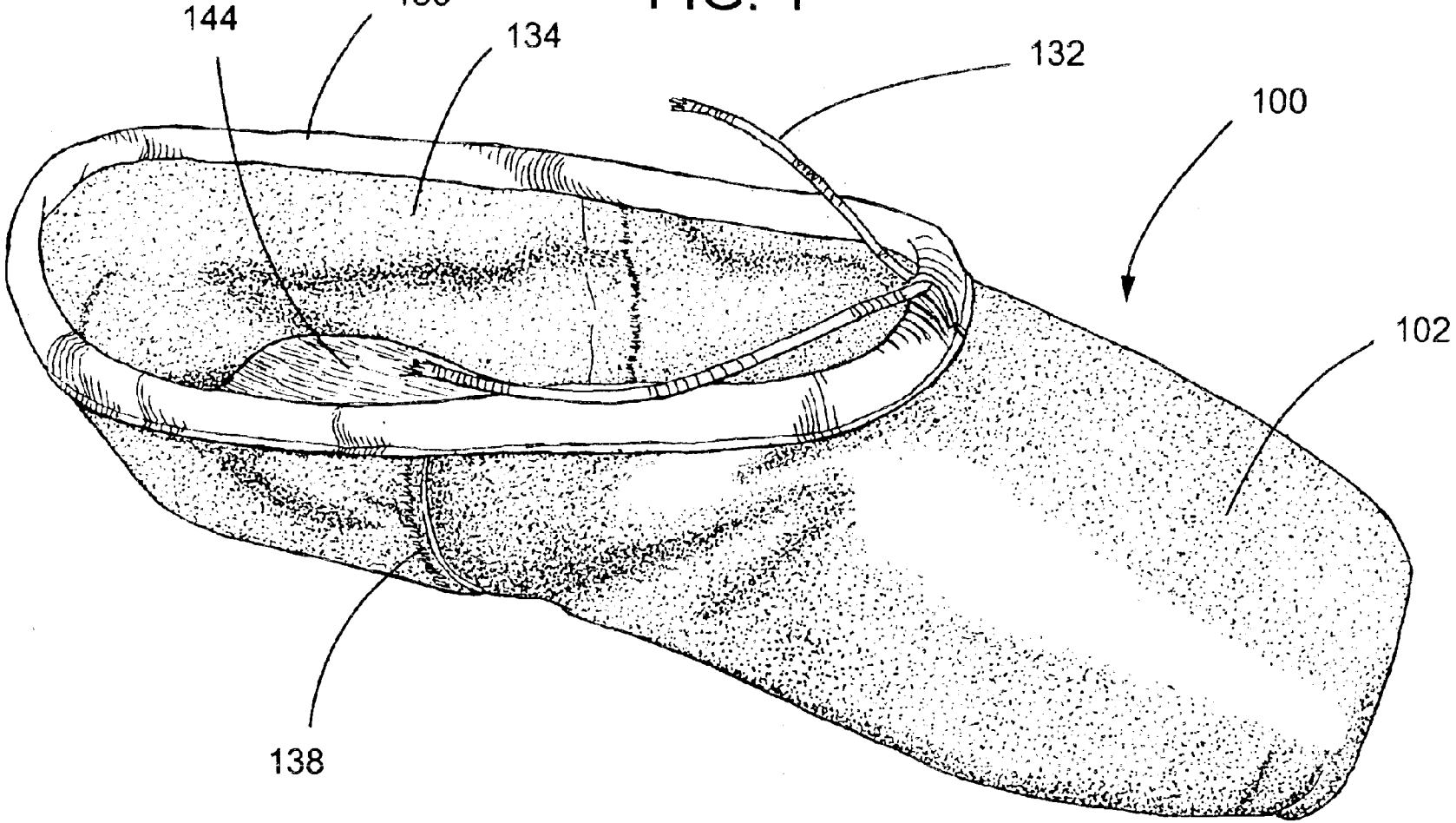
FIG. 1 is a perspective view of a dance shoe according to the invention.
Figure 2:
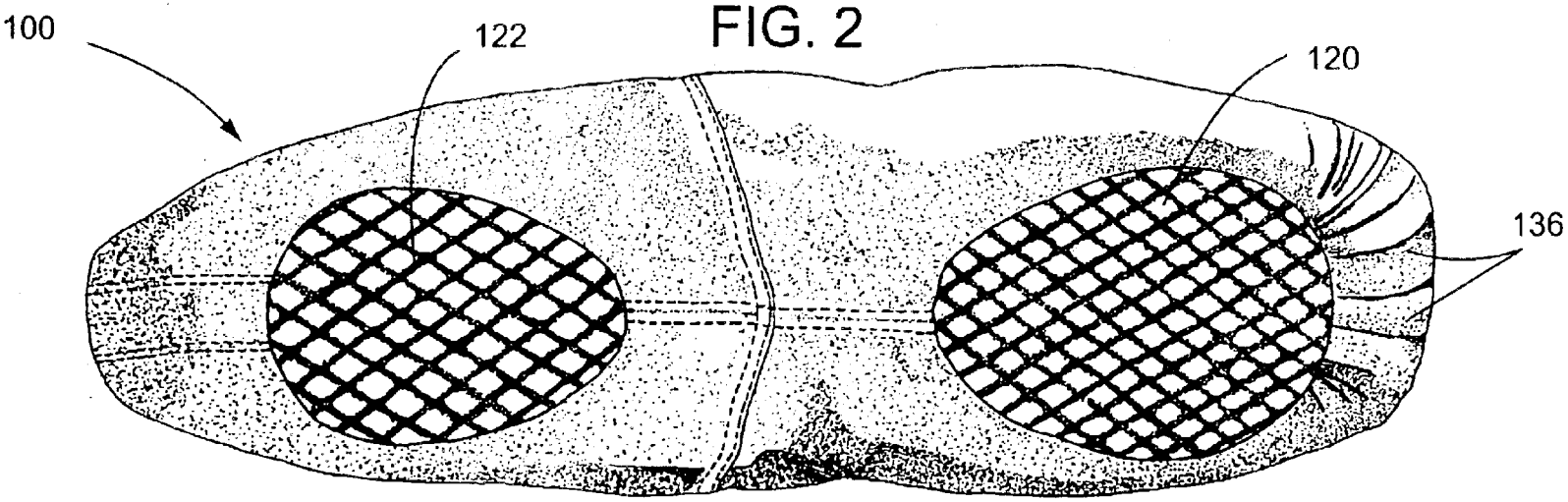
FIG. 2 is a bottom view of the dance shoe.
Figure 3:
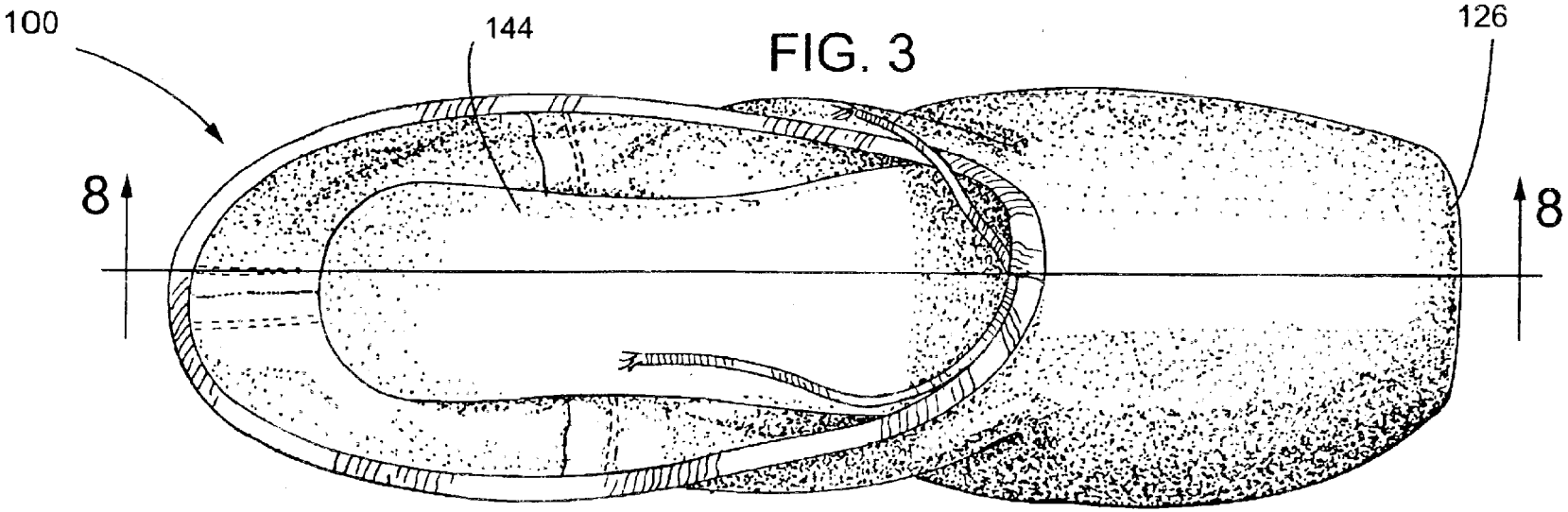
FIG. 3 is a top view of the dance shoe.
Figure 4:
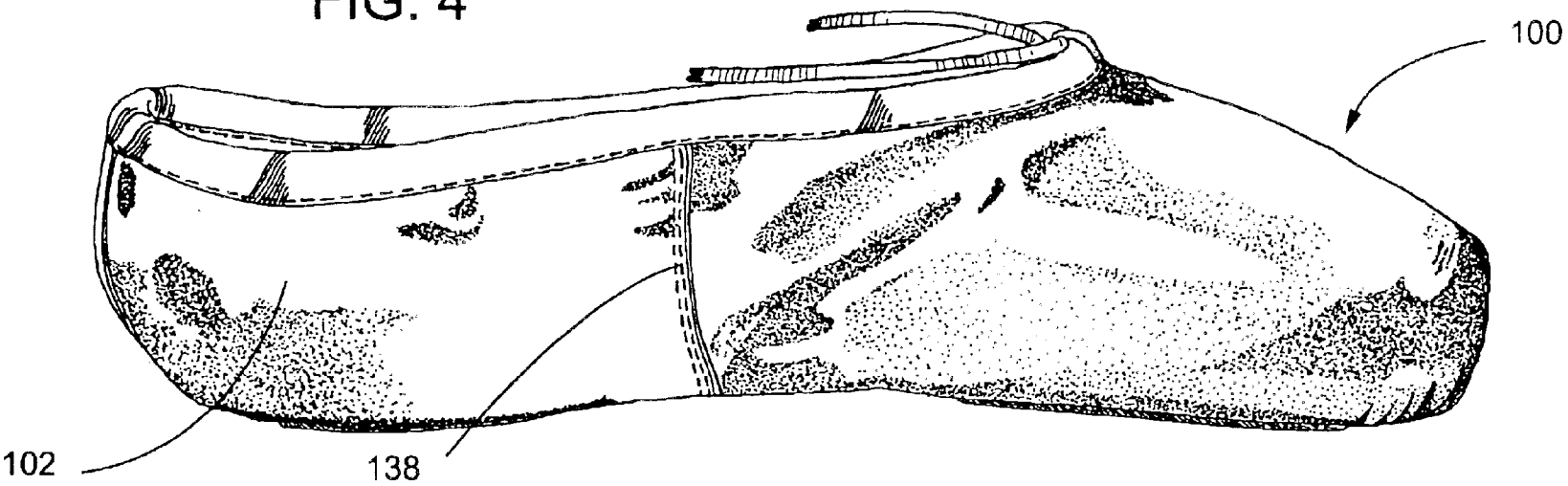
FIG. 4 is a side view of the dance shoe.
Figure 7:
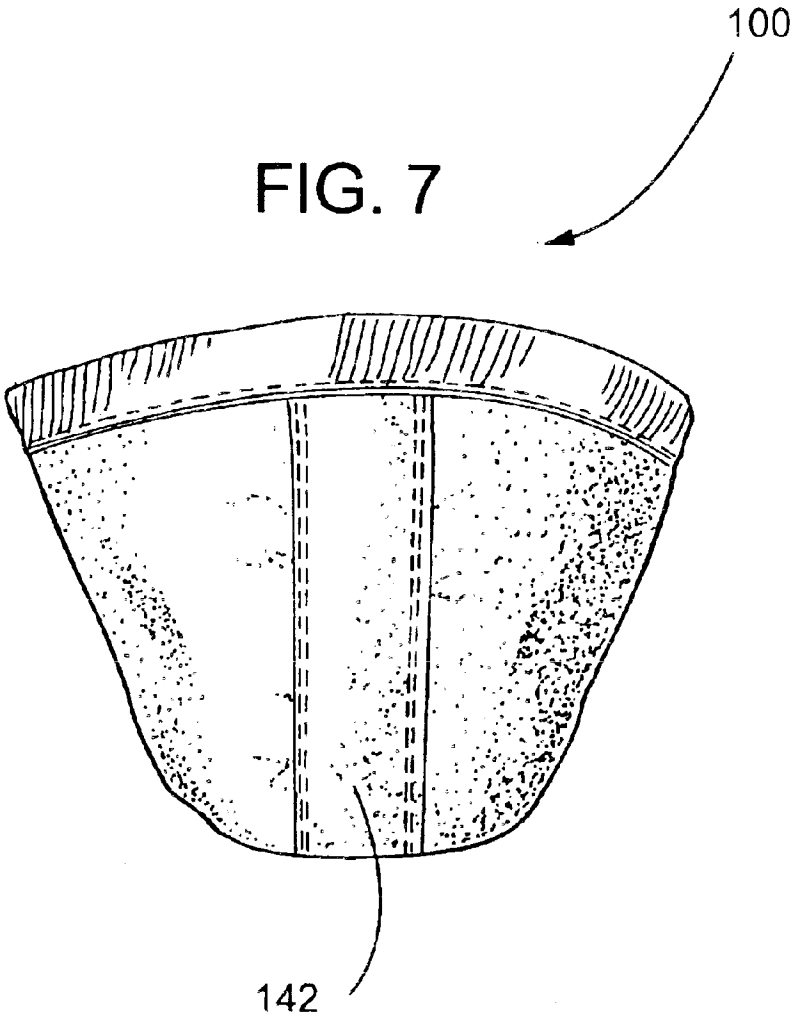
FIG. 7 is a rear view of the dance shoe.
Figure 6:
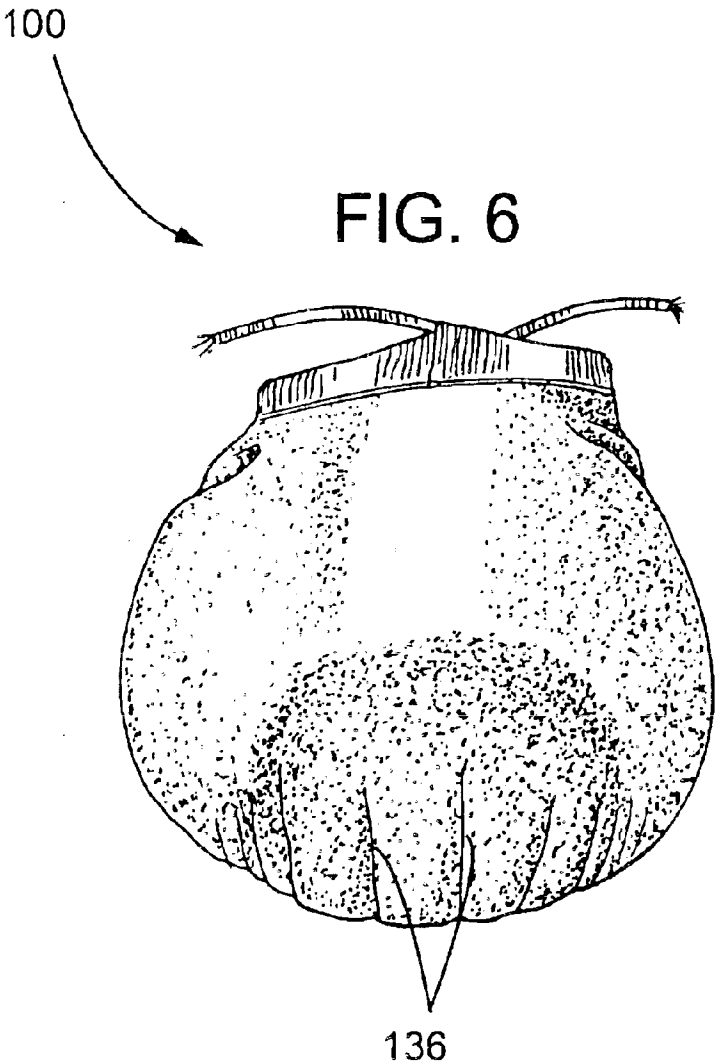
FIG. 6 is a front view of the dance shoe.
Figure 8:
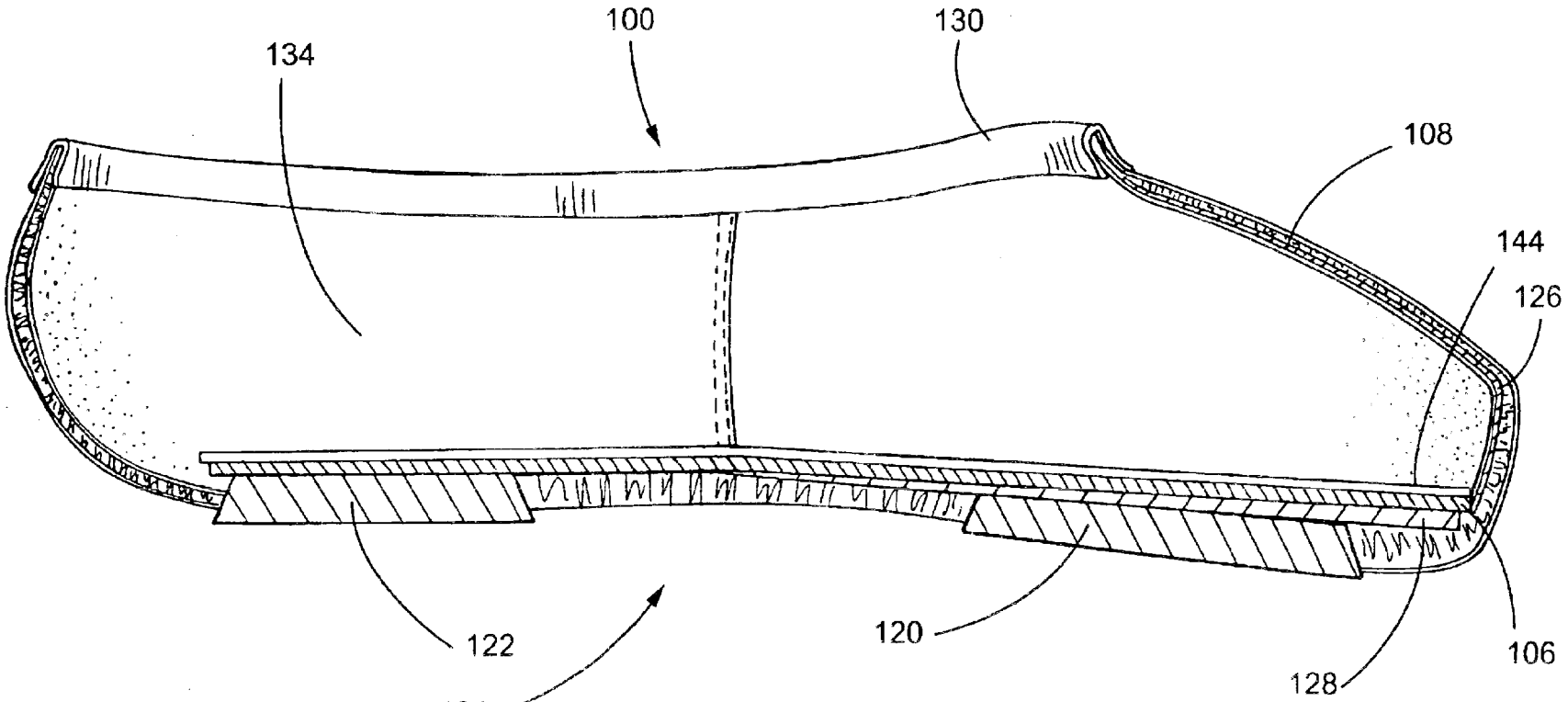
FIG. 8 is a cross-sectional view taken along line 8—8 in FIG. 3.

A pointe shoe 100 according to the invention is shown in FIGS. 1–8. Referring to FIGS. 1, 3 and 8, the pointe shoe 100 has an upper 102, a sole 104, a shank 106 and a toe box 108. The upper 102 surrounds the upper portion of the foot. The upper 102 may be made of a satin material, canvas, leather or various other soft materials. The sole 104 is a split sole and has a front sole 120 and a rear sole 122. The soles 120, 122 are located on the bottom of the shoe. Specifically, the front sole 120 may be located below the ball of the dancer's foot and the rear sole 122 may be located below the heel of the dancer's foot. The soles 120, 122 may be attached to the upper 102 with thread or adhesive, or a combination thereof.

The shank 106 is a stiff material on the inside of shoe which extends along the bottom of the dancer's foot. The shank 106 provides support for dancing on pointe. The shank may be made from redboard, other fiber boards, leather, or a polymer, such as, a plastic or an elastomer, or a combination of these materials. Redboard is a man-made fiber board which is made of fiber, and adhesive and which is red in color.

Figure 9:
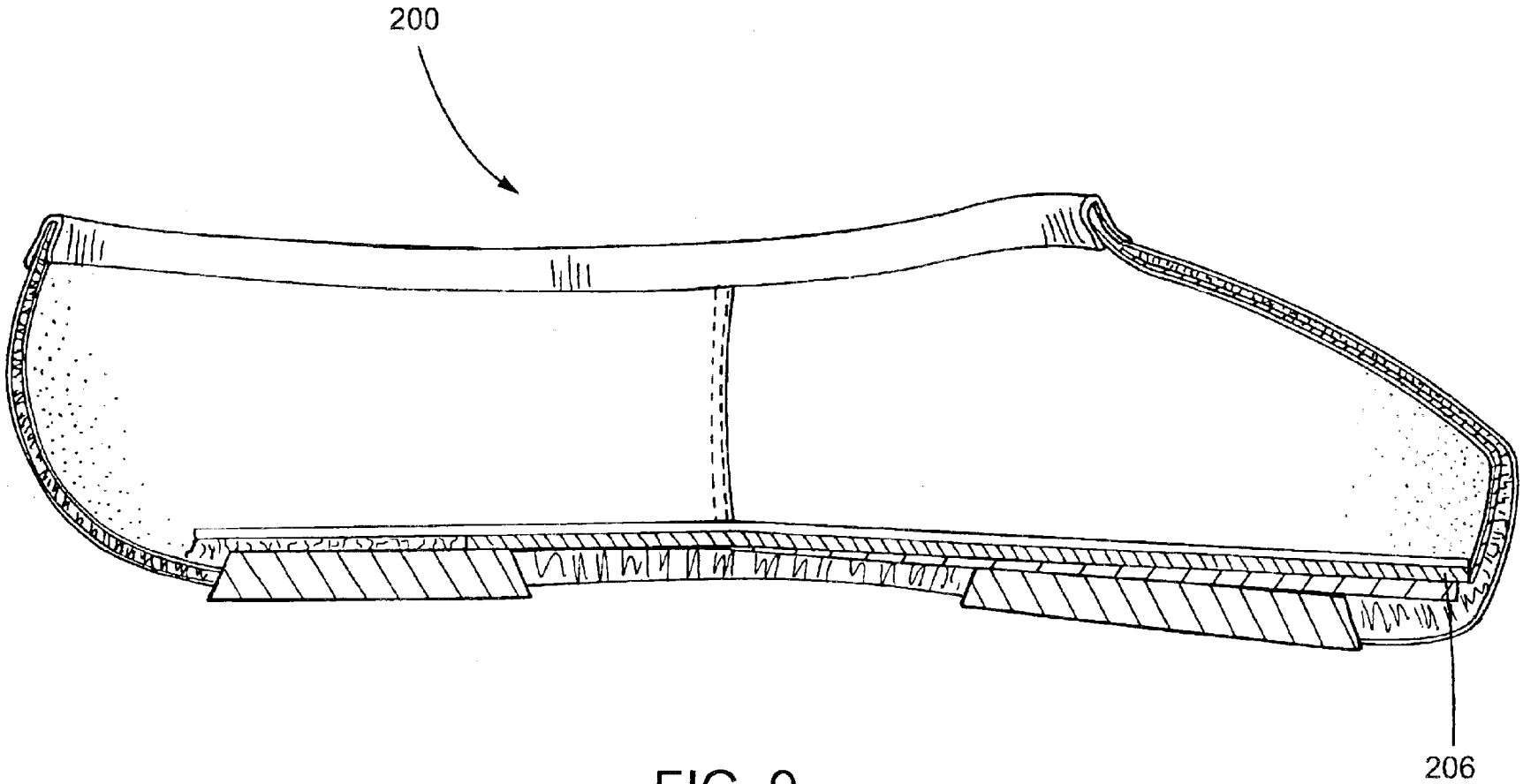
FIG. 9 is a cross-sectional view of another embodiment with a three-fourths shank.
Figure 10:
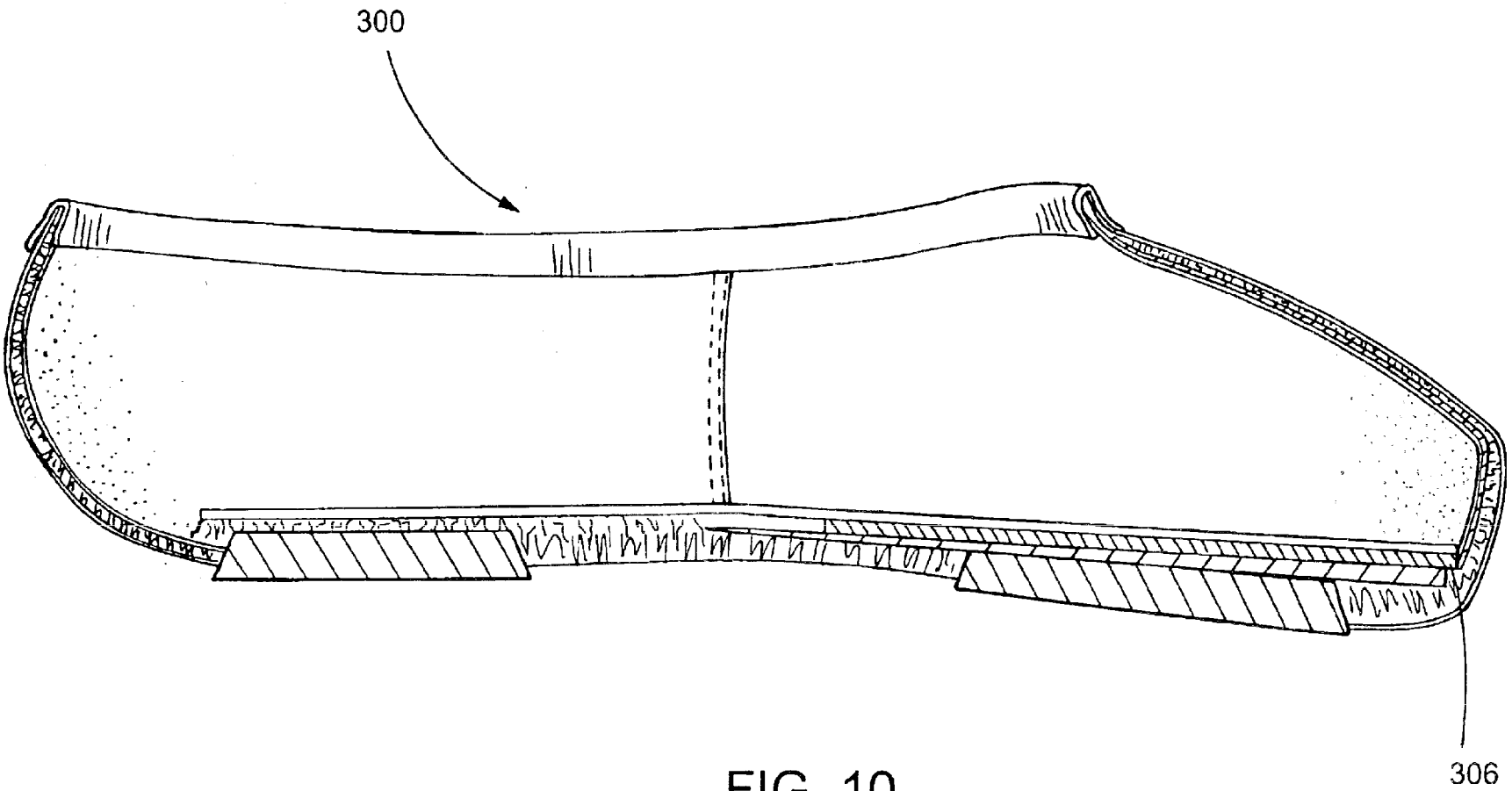
FIG. 10 is a cross-sectional view of another embodiment with a one-half shank.

The shank 106 may be available in different lengths. Referring to FIG. 8, the shank 106 extends from the front of the shoe to the back of the shoe. This type of shank is often referred to as a full shank. In another embodiment as shown in FIG. 9, the shank 206 extends from the front of the shoe 200 to three-fourths of the length of the shoe, and is referred to as a three-fourths shank. In another embodiment as shown in FIG. 10, the shank 306 extends from the front of the shoe 300 to the middle of the shoe, and is referred to as a one-half shank.

Figure 5:
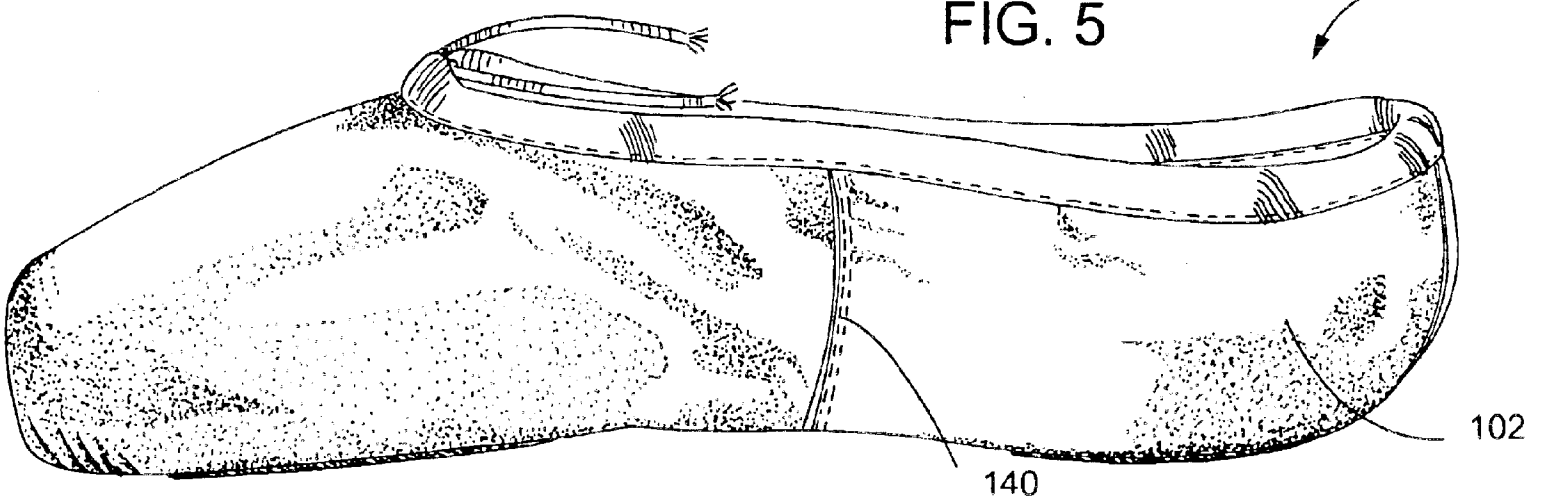
FIG. 5 is a side view of the other side of the dance shoe.

The toe box 108 is a rigid structure which covers the toes of the dancer and provides support for the dancer to stand en pointe. The toe box 108 is located at the front of the shoe and inside the upper 102. Referring to FIGS. 3, 5 and 8, the toe box 108 may have a flat tip 126 which allows the dancer to stand en pointe. In one embodiment, the toe box may be made from layers of paper and glue. In another embodiment the toe box may be made from layers of paper, fiber material and glue. In yet another embodiment, the toe box may be made of a polymer, such as, a plastic or an elastomer.

Referring to FIG. 8, the pointe shoe 100 may also include a midsole 128. The midsole 128 helps to reinforce the toe box 108. The midsole 128 may be made of leather, fiber board or a polymer, such as, a plastic or an elastomer.

Referring to FIG. 1, the pointe shoe 100 may also include a binding 130. The binding 130 is the finished edge of the upper 102 where the dancer inserts her foot. The binding 130 may include a drawstring 132 which helps to secure the shoe to the foot.

The upper 102 may include a lining 134 on the inside of the shoe as shown in FIG. 1. The lining 134 may be made of cotton, nylon, a wicking material, such as, Dri-Lex, or other soft material. The upper 102 may include pleats 136, side seams 138, 140 and a stay 142. The pleats 136 are located at the front of the toe box 108 and are created when the upper 102 is folded into the bottom of the shoe. The side seams 138, 140 join the fabric at the sides of the shoe. The stay 142 is a piece of fabric which covers the seam at the rear of the shoe as shown in FIG. 7.

Referring to FIGS. 3 and 8, the pointe shoe 100 may also include a sock lining 144. The sock lining 144 is located above the shank 106 and may extend from the front of the shoe to the back of the shoe.

Figure 11:
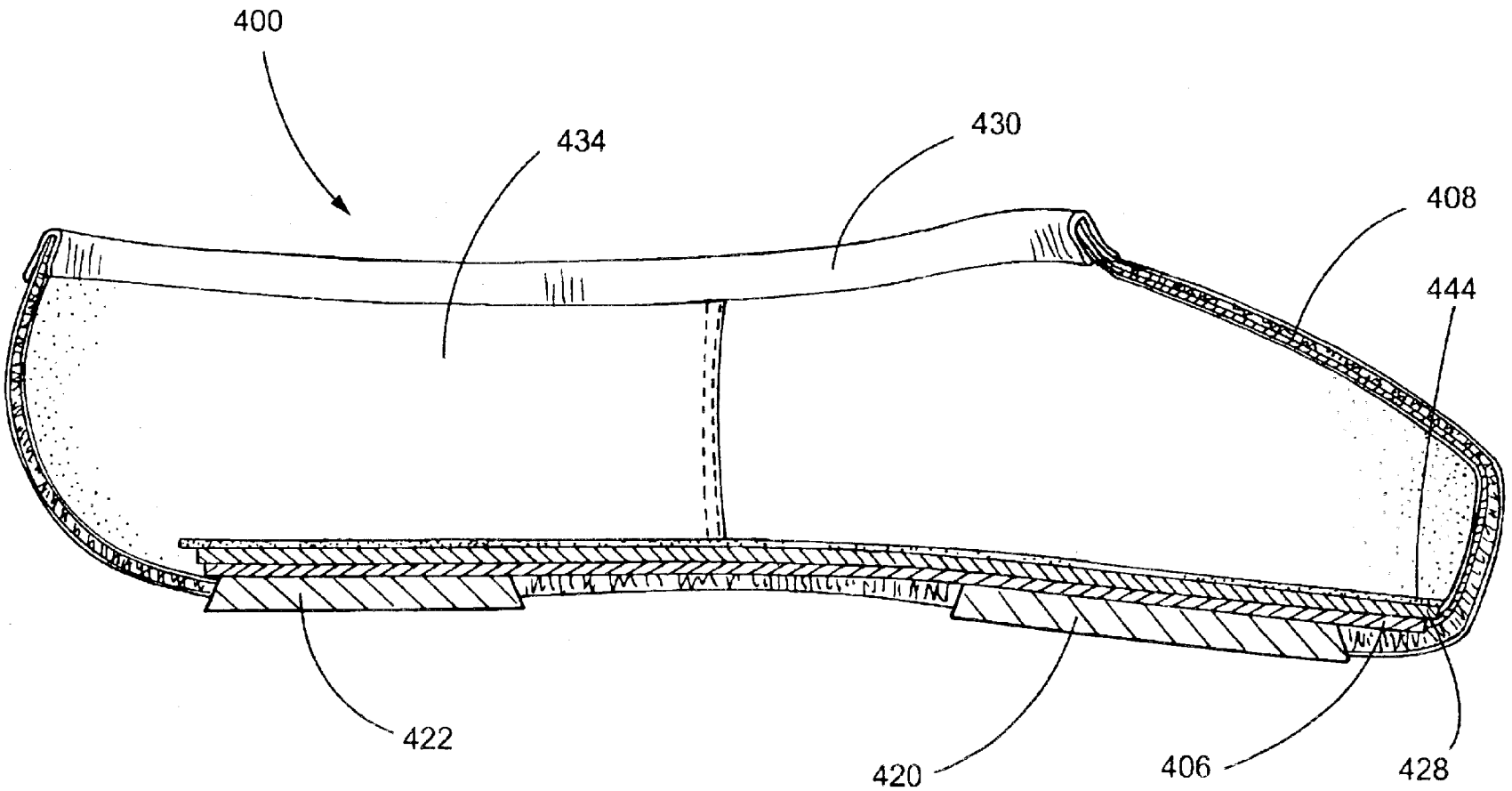
FIG. 11 is a cross-sectional view of another embodiment with a full shank.

FIG. 11 shows another embodiment of a pointe shoe 400. The pointe shoe 400 is similar to the pointe shoe 100 in FIG. 8 except for the midsole. In this embodiment, the midsole 428 extends from the front of the shoe to the rear of the shoe. The midsole 428 may be made of redboard, other fiber boards, leather or a polymer, such as, a plastic or an elastomer. In this embodiment, the shank 406 is a full shank. The shank 406 may be made of leather, fiberboard, or a polymer, such as, a plastic or an elastomer. The remaining components of the shoe 400 are similar to FIG. 8 and are similarly numbered, such as, the upper 402, the toe box 408, the soles 420, 422, the binding 430, the lining 434 and the sock lining 444.

Figure 12:
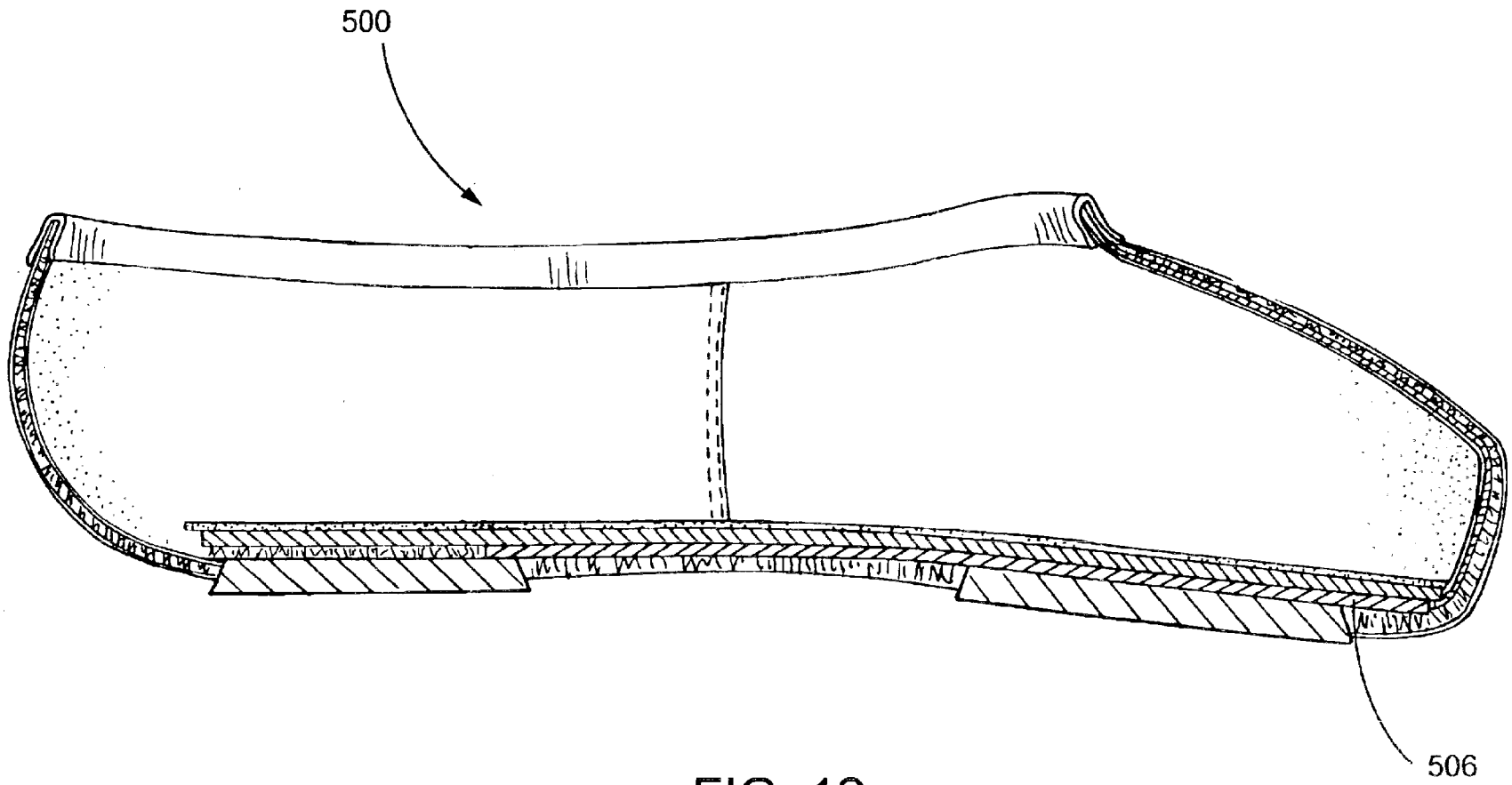
FIG. 12 is a cross-sectional view of another embodiment with a three-fourths shank.
Figure 13:
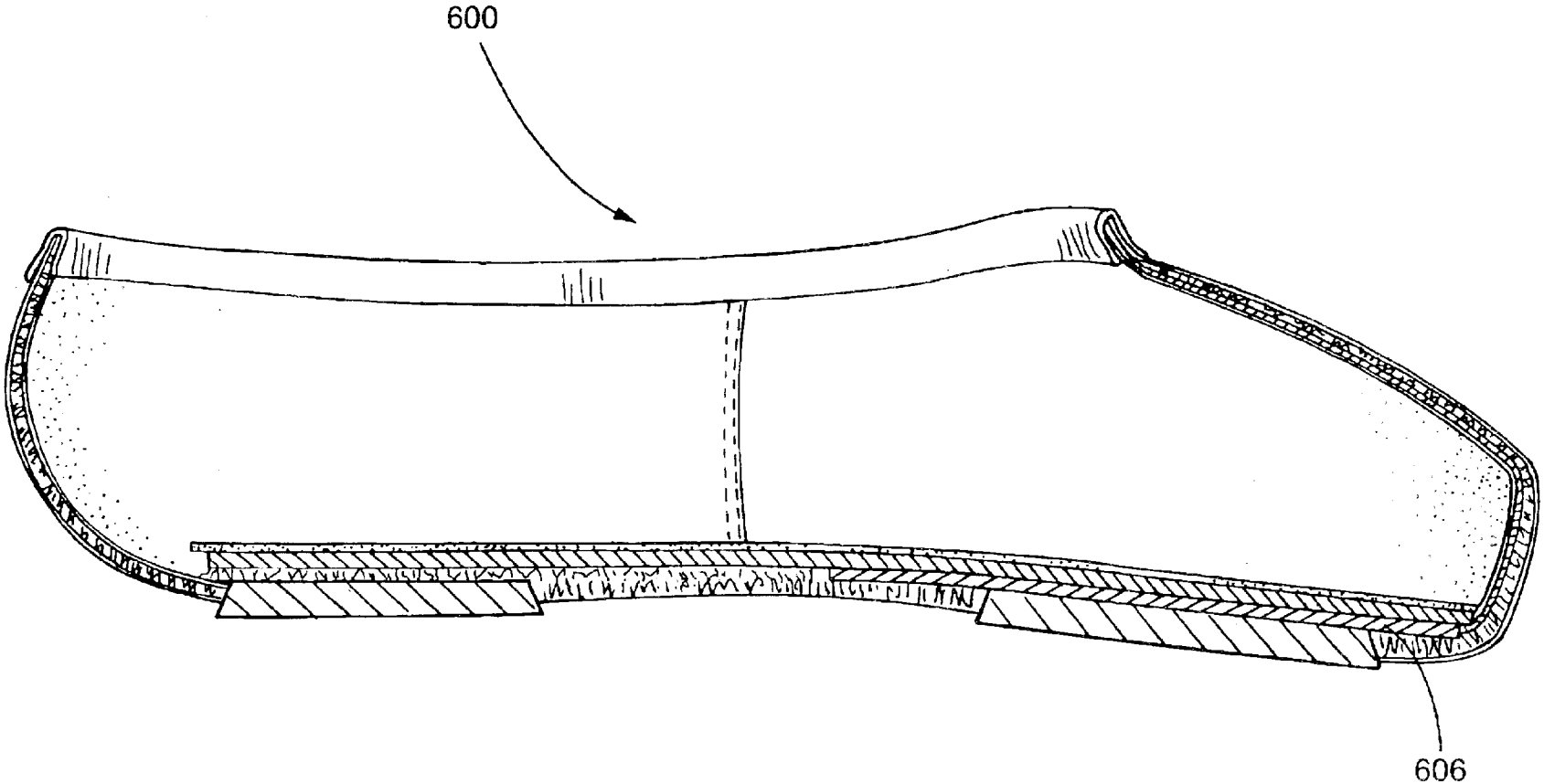
FIG. 13 is a cross-sectional view of another embodiment with a one-half shank.

Referring to FIG. 12, this pointe shoe 500 is similar to the pointe shoe in FIG. 11 except the shank 506 is a three-fourths shank. Similarly, the pointe shoe 600 shown in FIG. 13 is similar to the pointe shoe in FIG. 11 except the shank 606 is a one-half shank.

The split outer sole (i.e. the front and rear soles) provides several potential benefits. The split outer sole provides more flexibility than a full sole shoe due to the lack of sole in the middle of the shoe. Furthermore, support for dancing en pointe may be provided by the shank inside the shoe.

Another potential benefit of a split sole shoe is a faster "break in" of the shoe. A full sole shoe may be too rigid when it is new. A dancer may need to break in a full sole shoe. A dancer may put a full sole shoe in a vise or between a door and a door jamb, and bend the full sole shoe until the shoe becomes flexible. The split sole shoe is more flexible, and does not require as much breaking in. Thus, a split sole shoe is ready to dance right out of the box.

An additional potential benefit of a split sole shoe is that it is lighter in weight than a full sole shoe. The split sole shoe has less weight due to less sole material in the center of the shoe. Less weight allows the split sole shoe to feel more comfortable on a dancer's foot.

A further potential benefit of a split sole shoe is that the shoe makes it easier for the dancer to rise up on her toes in comparison to a full sole shoe. Due to the increased flexibility, the foot can articulate better to help the dancer get up en pointe easier.

Another potential benefit of a split sole shoe is that the shoe has a better appearance than a full sole shoe. The split sole shoe has a better appearance due to the lack of sole in the middle of the shoe. The split sole shoe creates a better looking line on the foot. Appearance of their feet is important to ballet dancers.

A pointe shoe may be manufactured in several different methods. One method is referred to as the "turn" method. Another method is referred to as the "non-turn" method. In the turn method, the pointe shoe is made by assembling the shoe from the inside out and then turning the shoe so that the outside of the shoe is on the outside. First, the toe box or block is made from layers of paper, glue or paste and possibly other materials. The upper is then attached to the toe box. The upper is usually made of satin but can also be made from other soft materials and has a lining. The toe box is positioned between the satin upper and the lining. The pleats are formed in the upper material, covering the toe box. The sole is attached to the last. Usually the sole is attached to the last with tacks. The sole is stitched to the upper with thread. The shoe is then removed from the last and turned so that the outside is on the outside. The shoe can be turned because the glue in the toe box has not dried and is still flexible. The shank and the sock lining are inserted and the shoe is reattached to the last. The toe box is formed and may be shaped with a hammer. The shoe is then allowed to dry and may be placed in an oven to speed the drying process. The binding is then applied to the shoe.

The method for making a non-turn shoe is as follows. The shank is attached to the bottom of the last. The shank may be attached to the last with tacks. The upper is placed on the last. The upper is usually made of satin but can also be made from other soft materials and has a lining. The satin is separated from the lining and the lining is glued to the bottom of the shank. The toe box is applied over the lining at the toe. The satin is glued over the toe box and the pleats are formed. The bottom of the shoe is trimmed and removed from the last. The sole is attached by using an adhesive or by stitching using thread.

In conclusion, it is to be noted that preferred embodiments of this invention are described herein, including the best mode known to the inventor for carrying out the invention. Of course, variations of those preferred embodiments will become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pointe shoe for ballet dancing comprising:

an upper to cover a portion of the foot;

a toe box which is rigid and provides support for a dancer to stand en pointe, the toe box surrounds the toes of the foot a shank; and a front sole and a rear sole which are attached to the upper, the front sole is located to be positioned under the ball of a dancer's foot the rear sole is located to be positioned under the heel of a dancer's foot.

2. The pointe shoe as in claim 1 wherein the front sole is made of leather.

3. The pointe shoe as in claim 1 wherein the rear sole is made of leather.

4. The pointe shoe as in claim 1 wherein the soles are attached to the upper by sewing.

5. The pointe shoe as in claim 1 wherein the soles are attached to the upper by adhesive.

6. The pointe shoe as in claim 1 wherein the soles are made of leather.

7. The pointe shoe as in claim 1 wherein the shank is a full shank.

8. The pointe shoe as in claim 1 wherein the shank is a three-fourths shank.

9. The pointe shoe as in claim 1 wherein the shank is a one-half-shank.

10. The pointe shoe as in claim 1 wherein the shank is made of redboard.

11. The pointe shoe as in claim 1 wherein the shank is made of leather.

12. The pointe shoe as in claim 1 further comprising a midsole.

13. The pointe shoe as in claim 12 wherein the midsole is located at the front of the shoe.

14. The pointe shoe as in claim 12 wherein the midsole is along the length of the shoe.

15. The pointe shoe as in claim 12 wherein the midsole is made of leather.

16. The pointe shoe as in claim 12 wherein the midsole is made of redboard.

17. The pointe shoe as in claim 1 wherein the toe box is made from paper and glue.

18. The pointe shoe as in claim 1 wherein the toe box is made of paper, glue and fiber material.

19. The pointe shoe as in claim 1 wherein the toe box is made of plastic.

20. The pointe shoe as in claim 1 wherein the toe box has a flat tip.

21. The pointe shoe as in claim 1 wherein the upper is made of satin.

22. The pointe shoe as in claim 1 wherein the upper includes a lining.

23. The pointe shoe as in claim 22 wherein the lining is made of cotton.

24. The pointe shoe as in claim 1 wherein the upper has pleats at the front.

25. The pointe shoe as in claim 1 further comprising a binding at the upper edge of the upper.

26. The pointe shoe as in claim 1 further comprising a sock liner which is located inside the shoe.

27. The method of making the pointe shoe in claim 1.

28. A method for making a pointe shoe comprising:

providing an upper to cover a portion of the foot;

providing a toe box which is rigid and provides support for the dancer to stand en pointe;

attaching the toe box to the upper;

providing a shank:

attaching the shank to the toe box;

providing a front sole and a rear sole; and attaching the front sole to the upper; attaching the rear sole to the upper.

29. The method as in claim 28 wherein the soles are attached to the upper by sewing.

30. The method as in claim 28 wherein the soles are attached to the upper by adhesive.

31. The method as in claim 28, wherein the soles are made of leather.

32. The method as in claim 28, wherein the shank is a full shank.

33. The method as in claim 28, wherein the shank is a three-fourths shank.

34. The method as in claim 28, wherein the shank is a one-half shank.

35. The method as in claim 28, wherein the shank is made of redboard.

36. The method as in claim 28, wherein the shank is made of leather.

37. The method as in claim 28, further providing a midsole.

38. The method as in claim 37, wherein the midsole is located at the front of the shoe.

39. The method as in claim 37, wherein the midsole is along the length of the shoe.

40. The method as in claim 37, wherein the midsole is made of leather.

41. The method as in claim 37, wherein the midsole is made of redboard.

42. The method as in claim 28, wherein the toe box is made from paper and glue.

43. The method as in claim 28, wherein the toe box is made from paper, glue and fiber material.

44. The method as in claim 28, wherein the toe box is made of plastic.

45. The method as in claim 28, wherein the toe box has a flat tip.

46. The method as in claim 28, wherein the upper is made of satin.

47. The method as in claim 28, wherein the upper includes a lining.

48. The method as in claim 47, wherein the lining is made of cotton.

49. The method as in claim 28, wherein the upper has pleats at the front.

50. The method as in claim 28 providing a binding at the upper edge of the upper.

51. The method as in claim 28 further providing a sock liner which is located inside the shoe.

52. The pointe shoe as in claim 28, wherein the front sole is made of leather.

53. The pointe shoe as in claim 28, wherein the rear sole is made of leather.

54. A pointe shoe for ballet dancing comprising:

an upper to cover a portion of the foot, the upper is made of satin, the upper includes a lining, the upper includes an upper edge with a binding;

a toe box which is rigid and provides support for a dancer to stand en pointe, the toe box surrounds the toes of the foot a shank; and a front sole and a rear sole which are attached to the upper, the front sole is located to be positioned under the ball of a dancer's foot, the rear sole is located to be positioned under the heel of a dancer's foot, the front sole is spaced apart from the rear sole, the front sole is made of leather, the rear sole is made of leather.

* * * * *

UNITED STATES PATENT AND TRADEMARK OFFICE

CERTIFICATE OF CORRECTION

PATENT NO. : 6,895,693 B2
DATED : May 24, 2005
INVENTOR(S) : Glenn M. Baruck

It is certified that error appears in the above-identified patent and that said Letters Patent is hereby corrected as shown below:

Column 4,
Line 55, before the "." insert -- , the front sole is spaced apart from the rear sole --.

Column 5,
Line 50, before the "." insert -- , the front sole is spaced apart from the rear sole --.

Signed and Sealed this

Fourth Day of October, 2005

JON W. DUDAS
*Director of the United States Patent and Trademark Office*